United States Patent [19]

Wraight

[11] Patent Number: 4,498,281

[45] Date of Patent: Feb. 12, 1985

[54] APPARATUS AND METHOD OF MAKING METALLIC CORD

[75] Inventor: Frederick G. Wraight, Strassen, Luxembourg

[73] Assignee: The Goodyear Tire & Rubber Company, Akron, Ohio

[21] Appl. No.: 488,560

[22] Filed: Apr. 25, 1983

[30] Foreign Application Priority Data

May 7, 1982 [LU] Luxembourg ..... 84134

[51] Int. Cl.[3] ..... D07B 3/12; D07B 3/02

[52] U.S. Cl. ..... 57/58.34; 57/58.3; 57/58.36; 57/58.52; 57/58.61; 57/58.63; 57/58.7; 57/311

[58] Field of Search ..... 57/3, 6, 58.3, 58.32, 57/58.36, 58.52, 58.57, 58.59, 58.63, 58.83, 58.86, 58.54, 58.55, 58.7, 311

[56] References Cited

U.S. PATENT DOCUMENTS

| | | | |
|---|---|---|---|
| 2,010,888 | 8/1935 | Pool | 57/58.32 |
| 2,567,329 | 9/1951 | Frazier | 57/58.34 |
| 2,921,428 | 1/1960 | Lütcke | 57/58.3 |
| 2,998,694 | 9/1961 | Haugwitz | 57/58.52 |
| 3,058,681 | 10/1962 | Clarkson | 57/58.3 |
| 3,902,307 | 9/1975 | Schoerner | 57/58.3 X |
| 4,030,248 | 6/1977 | Van Assendelft | 57/902 X |
| 4,335,571 | 6/1982 | Tarantola | 57/58.52 |

FOREIGN PATENT DOCUMENTS

| | | | |
|---|---|---|---|
| 3014190 | 10/1980 | Fed. Rep. of Germany . | |
| 58542 | 5/1976 | Japan | 57/58.57 |
| 8102273 | 5/1981 | Netherlands . | |

*Primary Examiner*—Donald Watkins

*Attorney, Agent, or Firm*—T. P. Lewandowski

[57] ABSTRACT

Method and apparatus for making metallic cords to be used as reinforcing members in elastomeric structures using a 2 for 1 strander (10) and a false twist principle to join together two elements comprising filaments or strands parallel in one element and twisted in the other element, and further maintaining separate tension levels on the two elements to provide a cord which is uniform in the helices which are formed by joining the two elements together.

13 Claims, 5 Drawing Figures

APPARATUS AND METHOD OF MAKING METALLIC CORD

The present invention relates to a method and apparatus for stranding together metal wires, either individual separate wires referred to herein as filaments or strands of a plurality of filaments, to produce metallic cord. The method and apparatus are particularly well adapted for making metallic cord to be used for reinforcing elastomeric articles such as tires, conveyor belts and alike.

It is well known to use steel wire for the production of metallic cord, and in the present description such an elementary wire will be referred to as a filament but it should be understood that the invention would not be limited to steel wire. Several filaments may be stranded together in a helical or non-helical arrangement to form a strand and these strands in turn may be stranded or twisted together in a helical arrangement to form a cord suitable for reinforcing one of the above articles.

Cords of the above-type construction are referred to as coreless in distinguishing them from those which are formed by filaments wound about a rectilinear central element, such as a filament or a strand, which is of a fixed core type.

It is known to produce coreless wire such as $4\times0.25$ on a 2 for 1 "twisting" type machine, commonly known as a stranding machine, having four internal spools feeding four filaments of 0.25 mm wire out of the inside of the machine over a rotating flyer and back into the machine to obtain two twists or turns on the filaments for every revolution of the flyer to produce a cord having four filaments twisted together.

The known machines for making two layer type cord are limited to a single path operation which gives half the production of the 2 for 1 type process of the stranding machine. Stranding machines only produce a twisted strand structure since they are twisting machines and not the two element type cord of the present invention and more particularly not a multifilament strand with zero twist as will be disclosed herein.

Another problem with stranding machines is the randomness of the twisting process known as being overcome by the use of preforming as in single pass and non-twisting machines.

The present method and apparatus overcome the above problems by providing individual tension control of the two elements of the cord while eliminating the need for preforming and devising a way to form two element cord on a stranding machine using a mechanical set and a false twist untwisting step as part of the method to obtain untwisted filaments in at least one strand of the cord construction.

The present invention has the advantages of the 2 for 1 operation wherein the equipment can either be operated at low speed in comparison to a single path machine, or, if operated at the same speed as a single path machine, twice the production.

Control of tension on the individual elements in the cord provides for a more uniform cord construction. The tension control further gives better control of back twist in the machine to also further enhance the uniform final construction of the cord. The final product retains the advantages of cord openess for rubber penetration and thereby the advantage of increased resistance to corrosion upon cut penetration of the elastomer surrounding the cord. The apparatus herein disclosed further has the advantage of independent tension control on the cord again to give a more uniform cord structure. The uniformity has permitted longer lay lengths with fewer turns per length to further increase production out of the machine for any given machine speed.

The above advantages, and others that may be understood from the following descriptive disclosure of the present invention, are accomplished by providing a method for producing metallic cords adapted to be used as reinforcing members in elastomer structures having a first element of two or more parallel filaments brought together with a second element of one or more filaments, the method comprising the steps of:

withdrawing a first group of filaments at a first tension from a plurality of stationary delivery spools and applying two turns on the first group of filaments forming the first element, withdrawing a second group of filaments forming a second element at a second tension from one or more stationary internal delivery spools, bringing the first and second elements together while maintaining the first and second tensions respectively thereon, and applying two turns to both elements in a direction opposite that applied above to the first element to remove the initial two twists from the first element while applying two twists to the second element to form a cord with a first element of two or more parallel filaments and a second element of one or more filaments which are helically formed one with respect to the other, subsequently mechanically setting the cord formed above to set the cord structure formed by joining the two elements together, and wrapping the above-formed cord on a supply spool.

Preferably in the above method braking forces are applied to the first and second elements between each fixed and rotating point throughout the system applying a double twist to the elements to form the cord.

The present invention further provides an apparatus for producing metallic cords adapted to be used as reinforcing members in elastomeric structures in a machine comprising:

a flyer mounted to be rotatable about its axis by drive means therefore, a shuttle mounted within the flyer to be freely rotatable relative thereto about the axis of rotation of the flyer, hollow bearings in the flyer and shuttle whereby a wire or wires may pass from the interior of the shuttle to the exterior of the flyer and vice versa, means for drawing wire from a spool on the shuttle and through the machine over the exterior of the flyer and to the finished cord, means for guiding wires into one end of the shuttle and out of its other end in a direction coinciding with the axis of rotation of the flyer, and means between fixed and rotating points on the machine for applying a brake force to the wires and cord to thereby control the tension in each of the discrete areas fixed between each fixed and rotating point.

The above features and advantages will be apparent upon reading the following description with reference to the accompanying drawings wherein.

Figure 1:
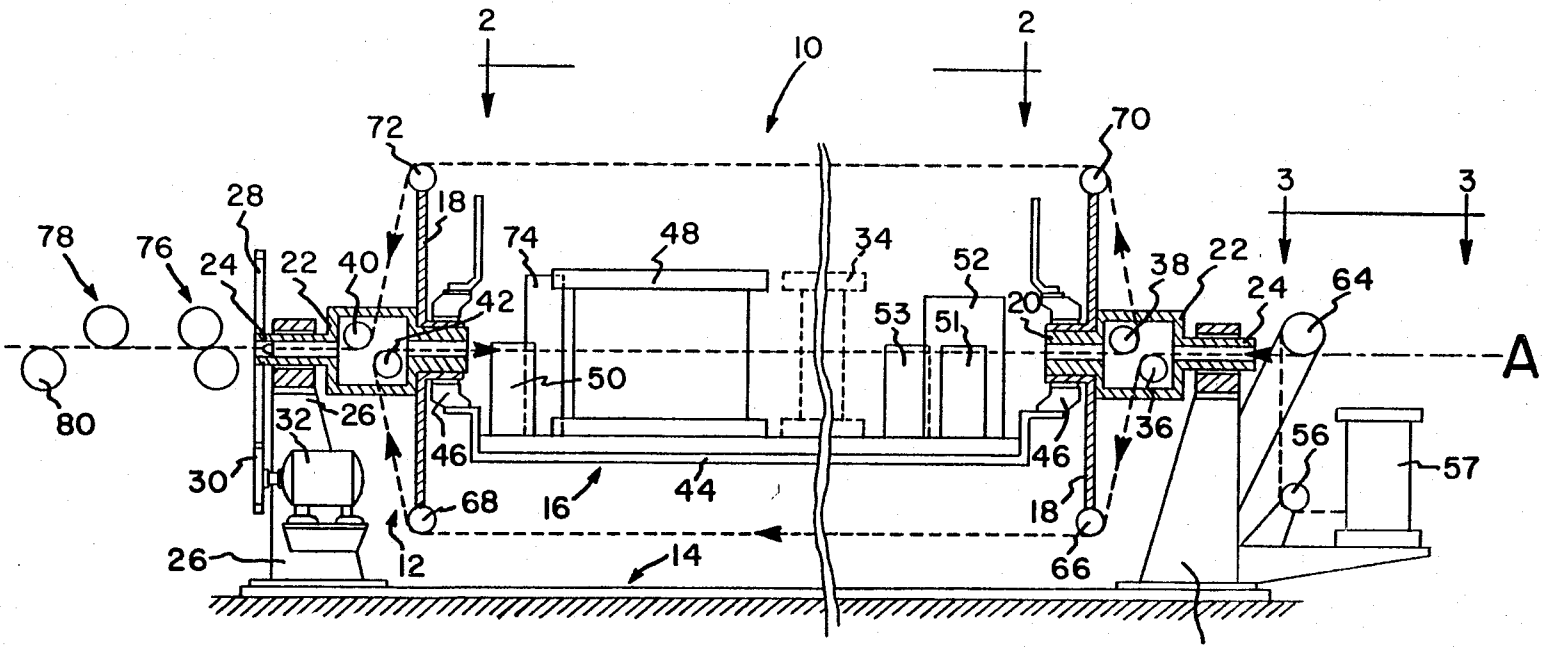
FIG. 1 is a diagrammatic illustration of the machine according to the invention with parts broken out.

Referring to FIG. 1, a machine 10 is disclosed having a flyer 12 supported by a base 14 to rotate the flyer 12 about its own horizontal axis denoted by the letter A. A shuttle 16 is mounted co-axially inside the flyer 12 and rotates freely with respect to it, making it fixed relative to the rotating flyer 12.

The rotating flyer 12 has two discs 18 co-axially disposed and spaced apart but fixed with respect to one another. Each disc 18 has a hollow hub 20 fixed with respect to a frame 22 disposed axially outside the flyer 12, which, in its turn, is fixed with respect to a sleeve 24 which is also hollow and co-axial to the hub 20.

Each sleeve 24 is mounted in a corresponding support 26 of the base 14, through roller bearings or ball bearings or any other arrangement that allows free rotation of the sleeve 24.

The sleeve 24 has a gear 28 co-axially affixed to it that engages with a corresponding gear 30 connected to a motor 32 fixed to the base 14.

Frames 22 support freely rotating sunken pulleys 36–42 which have axes of rotation perpendicular to the flyer axis A to which the pulley peripheries are tangential.

The hubs 20 extend within the flyer 12, and serve as a support for the shuttle 16 which has a frame work 44 supported by bushings 46 mounted on and co-axial with the hubs 20 to provide free rotation to the shuttle 16.

Figure 2:
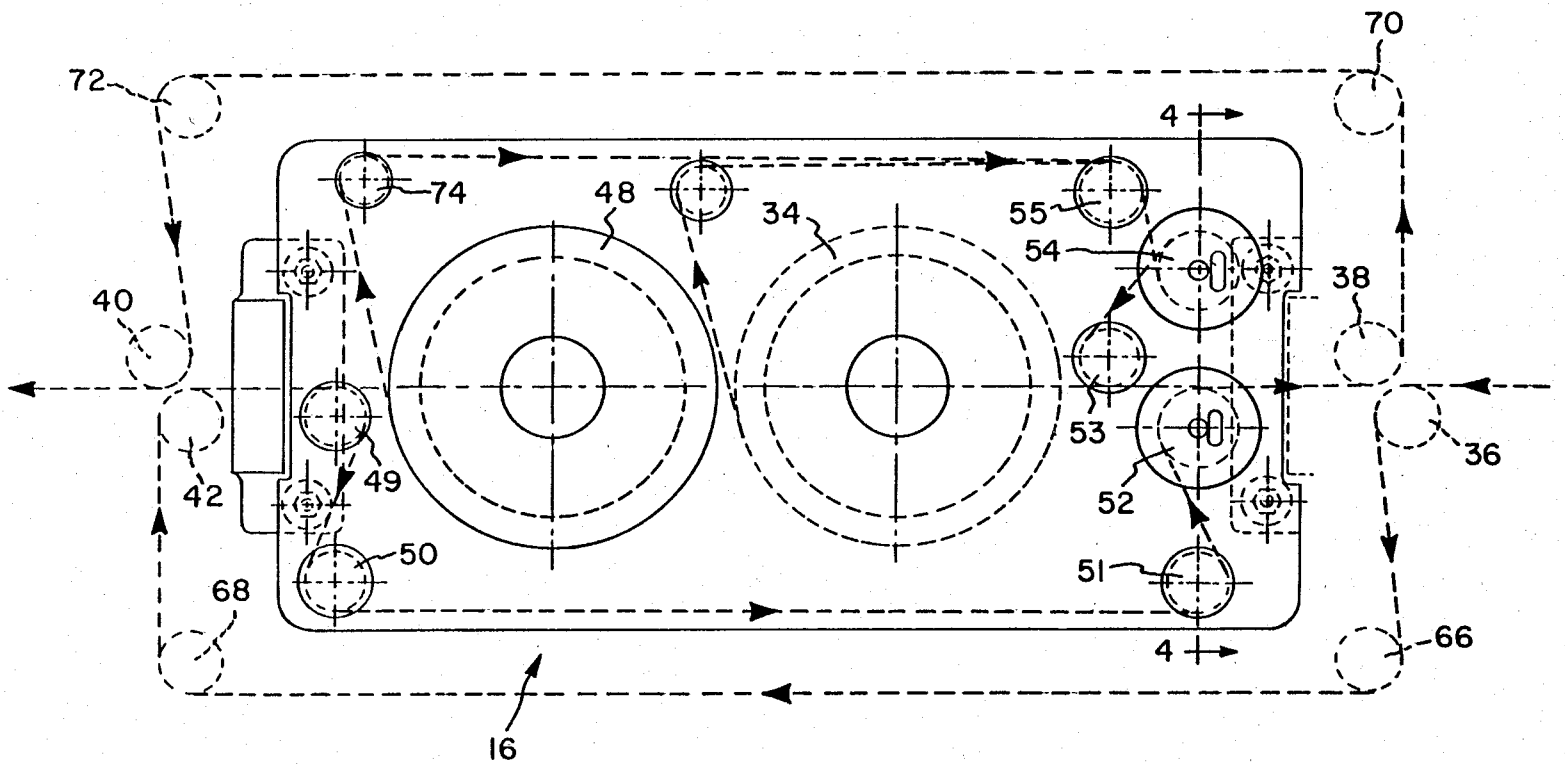
FIG. 2 is a view taken along lines 2—2 of the machine in FIG. 1.

As best illustrated in FIG. 2, the shuttle 16 supports internal spools of wire 34 and 48, idler rollers 49, 50, 51, 53 and 55 and brake capstans 52 and 54 all of which have their axis of rotation perpendicular to that of the flyer axis A. The idler rollers 50 are free to rotate about their axes while the spools 48 are provided with drag brakes to prevent the spools from overriding, the wire being let off of the spools.

The brakes for the spools 48 are drag brakes well known to those skilled in the art. The brakes for the brake capstans 52 are also drag brakes, but adjustable to permit adjustment of the tension on the wire wrapped around them. Examples of braking means for providing such tension adjustment would be self-adjusting or active tensioning brakes.

Figure 3:
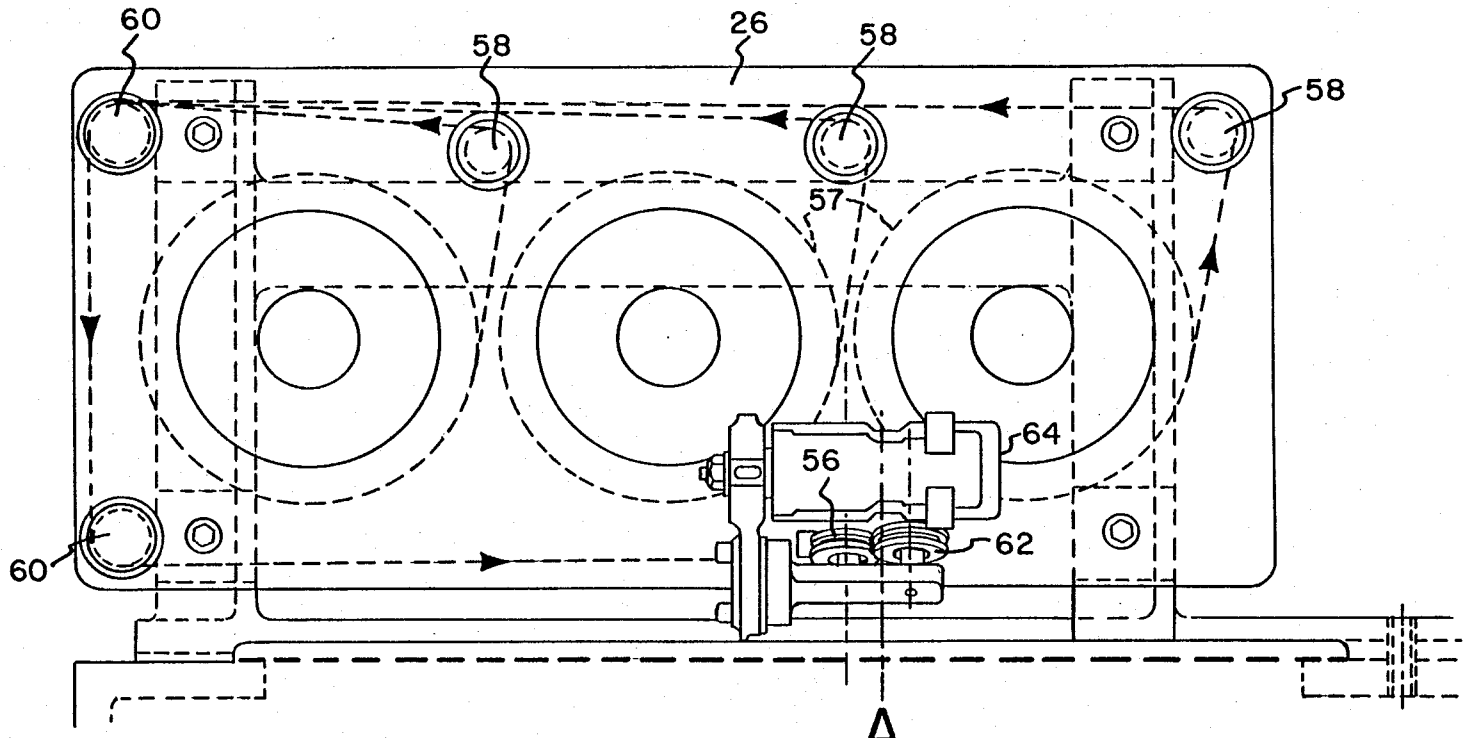
FIG. 3 is a view along lines 3—3 of FIG. 1.

Referring to FIGS. 1, 2 and 3 and more particularly to FIG. 3, wire spools 57 are illustrated being supported on the support 26, in a manner similar to that described for the spools 34 and 48 mounted on the shuttle 16 inside the machine 10. Three spool positions are illustrated in FIG. 3 with the wire being fed from them being directed across idler pulley 56 after the filaments from each spool have been gathered by passing them over guide idler posts 58 having been gathered and passed on by idler pulleys 60. The gathered wires then pass from idler 56 in an upward direction to idler 62 which feeds the group of filaments to the brake-capstan 64 which has an adjustable brake as described for the brake-capstans 52 and 54 mounted on the shuttle 16. From the brake-capstan 64 the three filaments pass through the hollow sleeve 24 in FIG. 1, and down over sunken pulley 36 across the flyer pulleys 66 and 68 and up over the sunken pulley 42 to reenter the shuttle 16 through the hollow hub 20. As best illustrated in FIG. 2, wherein the sunken pulleys 36–42 and flyer pulleys 66–72 are illustrated in phantom to better depict the path of the wire filaments, the three filaments pass from the sunken pulley 42 to the idler pulleys 49, 50 and 51 which guide the filaments around the wire spool positions to the brake-capstan 52. In one rotation of the flyer 12, the three filaments are given two turns in one direction. A single filament is drawn off of internal wire spool 48 about the guide idler post 74, past idler pulley 55 and is wrapped around brake-capstan 54 to finally pass around the idler pulley 53 on the center line of the flyer 12 where it joins the three filaments as they all pass the point of tangency of the brake-capstan 52 with the center line of the flyer 12. As all the filaments pass the sunken pulley 38 they are given one turn for every revolution of the flyer 12, but in the opposite direction to that given to the three filaments which up to this point have had two turns for every revolution of the flyer. Thus, at this point the three filaments having passed sunken roll 38 have one turn left in the original direction and the one filament has gained one turn in the opposite direction. The four filaments pass over the flyer pulley 70 and across the flyer 12 to turn down over the flyer pulley 72 and around sunken pulley 40, putting another turn in the opposite direction in the one filament while removing the second turn from the three filaments resulting in two turns being in the single filament and the three filaments being parallel because both the initial turns have been removed from them.

Returning to the brake-capstan 52 which is tangential to the center line of the flyer 12, at this point in addition to turning the individual filaments, as the single filament and the three filaments come together they are treated as separate elements or two individual strands which upon receiving a turn between the sunken pulley 38 and brake-capstan 52 are further joined one to the other with helices of equal pitch. It should be noted that at this point the three filaments having previously had two turns applied to them per revolution of the machine have had one turn removed and the single filament having previously had no turn applied to it has received a single turn so that the two elements would have equal lay lengths but with turns in the opposite direction at this point. The two elements together pass over idler pulley 70 and across the flyer 12 to its idler pulley 72 and then down around the sunken pulley 40 where the final turn is removed from the three filament element resulting in the three filaments being parallel and the final turn is given to the single filament to give it its appropriate lay length. The finished cord passes through the hollow sleeve 24 of the flyer 12 as best illustrated in FIG. 1, and onto a false twist mechanism 76 illustrated schematically as two rollers about which the finished cord makes a figure eight configuration to overtwist the cord thereby setting its configuration and then removing the overtwist before passing onto the tensioning unit capstan 78 which supplies the pull through force for the machine 10. The cord then passes onto a wind-up spool 80, both the wind-up spool and tensioning unit capstan also being schematically illustrated in FIG. 1.

Figure 5:
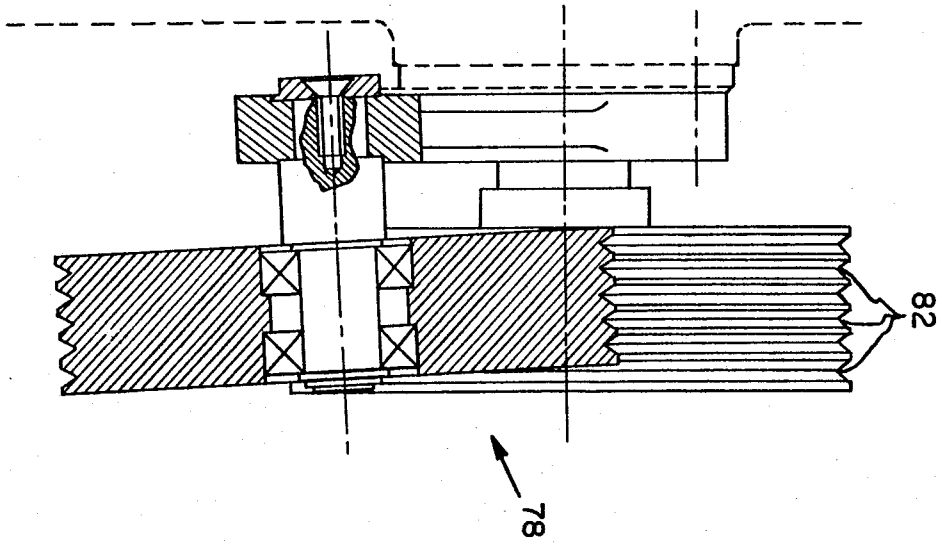
FIG. 5 is a detailed figure of the tensioning unit capstan illustrated in FIG. 1.

The tensioning unit for the tensioning unit capstan 78 is conventional and well known to those skilled in the art as is the drive for the wind-up spool 80, neither of which are therefore further described or illustrated herein. The tensioning unit capstan 78 is shown in further detail in FIG. 5 (illustrated without the cord for clarity) wherein it can be seen that its surface has grooves 82 for receiving the finished cord. It was found that in wrapping the capstan with a cord formed by the new method it was advantageous to separate the cord with the grooves 82, while the cord was under the high tension of the tension setting unit to avoid cord entanglement.

Figure 4:
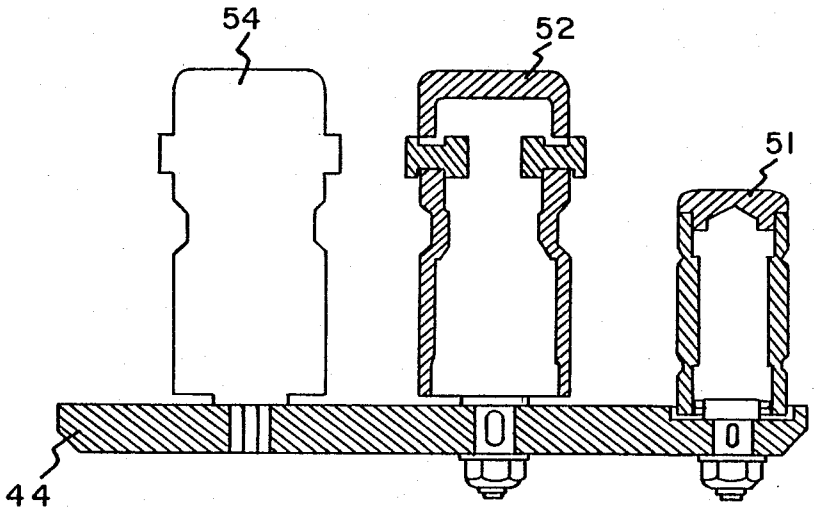
FIG. 4 is a cross-section taken along lines 4—4 of FIG. 2.

Referring to FIGS. 1, 2 and 4, it was found advantageous to place brake-capstan 64 at the fixed point defined by its tangency with the three filament element, to control the tension on the element which is turned by the rotating sunken pulley 36. As mentioned above, the brake capstan 64 is provided with adjustable braking to enable the setting of tension on the three filament element. In a similar manner brake-capstan 54 around which the single filament element is wrapped controls the tension in the single filament element between its fixed point, at the point of tangency between the flyer center line A and idler pulley 53, and the sunken roller 38 which is the rotating point. The tension on the three filament element is further controlled by the capstan 52 which is tangent to the flyer center line A. It was found in practice that a tension of 7.4 kilograms ±0.2 kilograms (740 N±20 N) worked best on the three filament element and a tension of 2.4 kilograms±0.2 kilograms (240 N±20 N) for the single filament. It was found that if the tension levels were reversed with a higher tension being placed on the single filament element and a lower tension on the three filament element the process would not work.

Further, it was determined that the tension required is a characteristic of the machine rather than the wire product alone, for example when making a cord of equal filament elements, for example two filaments in each element, the two parallel filaments required a higher tension, up to 6 kilograms±0.2 kilograms (600 N±20 N) as compared to 4.2 kilograms ±0.2 kilograms (430 N±20 N) for the two filament element receiving the initial two turns rather than a balanced tension on the two elements as might be expected.

Referring to FIG. 3 of the drawings, it is to be understood that a three filament cord, as opposed to the described four filament cord, can be made, wherein one of the elements of the three filament cord is comprised of two parallel filaments. One of the three spools illustrated would be eliminated to thereby provide two filaments along the path previously described for the three parallel filaments. The finished cord produced would be two parallel filaments joined together with a single filament. Another embodiment would be a cord wherein the first element comprised the above two parallel filaments and the second element comprised two twisted filaments.

Referring to FIG. 2, a second wire spool 34 shown in phantom, can be placed in the shuttle 16 with a single filament drawn therefrom and passed around guide idler post 84 to join the filament coming off of the other wire spool 48 as the two filaments pass around the idler pulley 55 and onto the brake-capstan 54. As pointed out above, the brake-capstan 54 in this embodiment would be adjusted to provide a tension on the two filaments of approximately 4.2 kilograms (420 N). As the two filaments, which are untwisted, pass about the brake capstan 54 past the idler pulley 53 which is tangent to the center line of the flyer 12 they join the other element wrapped around the brake capstan 52 which is also tangent to the center line of the flyer 12 whereby the two elements are joined together between the sunken pulley 38 and brake-capstan 52.

Of course the first element now comprises only two filaments, which two filaments have received the same treatment as described above for the three filaments, whereby two turns have been introduced to them prior to reaching the point of joining the second element which has no turns applied to it. Thus, the first element in passing the sunken pulley 38 has one turn removed of the two turns it was given since the turn is in the opposite direction of the previous two, and the second element receives its first turn which simultaneously brings the two elements together. The two elements pass together over the flyer pulleys 70 and 72 and down over the sunken pulley 40 where a last turn is applied to both elements. The second element now has two turns per revolution of the flyer 12 and the last turn initially put into the first element has been removed resulting in a cord structure where the first element consists of two parallel wire filaments and the second element has two twisted wire filaments wherein the lay length and the number of turns of the twisted filaments in the second element correspond to the lay length of the two elements forming the cord.

For the three cords described above, it was found that the cord had uniform lay length. At a lay length of 14 mm which was an increase over the previous 12 or 12.5 mm lay length, there resulted an increase in output from the machine since for the longer lay length fewer turns per length of wire need to be introduced to achieve the final cord structure.

The method as well as the principle and mode of operation of the machine have been explained and what is considered to represent its best embodiments have been illustrated and described. It should, however, be understood that the invention may be practiced otherwise than as specifically illustrated and described without departing its spirit or scope.

While certain representative embodiments and details have been shown for the purpose of illustrating the invention, it will be apparent to those skilled in this art that various changes and modifications may be made therein without departing from the spirit or scope of the invention.

I claim:

1. Apparatus for producing metallic cords adapted to be used as reinforcing members in elastomeric structures in a machine having a rotating flyer with flyer pulleys to guide wire over the flyer and sunken pulleys to guide wire to and from the flyer axis of rotation (A) all of which rotates with the flyer, a shuttle mounted within the flyer freely rotatable relative thereto about the flyer axis (A) for supporting internal spools of wire from which wire or wires may pass from the interior of the shuttle passing over sunken pulleys to the exterior of the flyer on the flyer pulleys, means for guiding and drawing wires from external spools of wire through the machine and over the flyer on flyer pulleys together with the wires from the internal spools comprising: idler rollers on the shuttle for guiding wires from the internal and external spools around the internal spools including idler rollers tangent to the axis of the flyer (A) for guiding wires into and out of the shuttle, a brake-capstan on said shuttle in the path of the wire between the internal spools and the sunken pulley directing wires from the shuttle over the flyer on flyer pulleys, another brake-capstan on said shuttle in the path of the wire between the external spools and the sunken pulley directing the wires from the shuttle over the flyer on flyer pulleys, each brake capstan applying independent braking force to the wires received thereon to control the tension in both the wire or wires from the internal spools and wire or wires from the external spools which are joined together upon reaching the sunken pulley which directs all the wires over the flyer on flyer pulleys to exit the machine by the redirecting of the sunken pulley directing the now formed cord from the machine on the flyer axis A.

2. Apparatus for producing metallic cords adapted to be used as reinforcing members in elastomeric structures in a machine having a flyer mounted to be rotatable about its axis by drive means therefor, a shuttle mounted within the flyer to be freely rotatable relative thereto about the axis of rotation of the flyer, hollow bearings in the flyer and shuttle whereby a wire or wires may pass from spools on the interior of the shuttle to spools on the exterior of the flyer and vice versa, means for drawing wire from a spool on the shuttle and through the machine over the exterior of the flyer and to form cord, and means for guiding wires into one end of the shuttle and out of its other end in a direction coinciding with the axis of rotation of the flyer comprising:

means for applying a braking force to the wires and cord located on the machine between fixed non-rotating and rotating points for the wire and cord to thereby control the tension on discrete locations between a fixed non-rotating and rotating point for the wire and cord.

3. The apparatus defined in claim 2 wherein the means for applying a braking force further includes means for controlling the tension in some of the wires at a level different from that of other of the wires.

4. The apparatus defined in claims 2 or 3 wherein said means for applying a braking force further includes brake-capstans for tension controlling means.

5. The apparatus defined in claims 2 or 3 further including a brake-capstan between the spools on the interior of the shuttle and the flyer for receiving the wires from the interior spools, another brake-capstan between the spools on the exterior of the flyer and the flyer for receiving wires from the external spools, each brake capstan applying independent braking force to the wires received thereon to control the tension in discrete groups of wire at locations between a fixed and a rotating point of the machine.

6. The apparatus defined in claim 2 wherein said means for drawing wire through the machine includes a grooved tension unit brake-capstan.

7. A method for producing metallic cords adapted to be used as reinforcing members in elastomer structures having a first element of two or more parallel filaments brought together with a second element of one or more filaments, the method comprising the steps of:

withdrawing a first group of filaments at a predetermined tension from a plurality of delivery spools and applying two turns to the first group of filaments forming the first element, withdrawing one or more filaments forming a second element at a predetermined tension independent from the tension on said first group of filaments from one or more internal delivery spools, bringing the first and second elements together while maintaining the predetermined tensions respectively thereon, applying two turns to both elements in a direction opposite that applied above to the first element to remove the initial two turns from the first element while applying two turns to the second element to form a cord with a first element of two or more parallel filaments and a second element of one or more filaments which elements are helically formed one with respect to the other, and subsequently mechanically setting the cord formed above to set the cord structure formed by joining the two elements together.

8. The method defined in claim 7 wherein said second element is formed by withdrawing a single filament from a single fixedly located internal delivery spool.

9. The method defined in claim 7 wherein the first element is formed by withdrawing two filaments one from each of two fixedly located external delivery spools, and the second element is formed by withdrawing a single filament from one fixedly located internal delivery spool.

10. The method defined in claim 7 wherein the tension on said first element is greater than the tension on said second element.

11. The method defined by claim 8 wherein there are three wires in said first element and the tension on said first element is about 7 kilograms (700 N) and there is one wire in said second element and the tension on said second element is about 2 kilograms (200 N).

12. The method defined in claim 7 wherein there are two wires in said first element and the tension on said first element is about 6 kilograms (600 N) and there are two wires in said second element and the tension on said second element is about 4 kilograms (400 N).

13. A method for producing metallic cord adapted to be used as reinforcing members in elastomeric structures in a strander having the capability of introducing two turns into a filament of wire passing there through for each revolution of the strander, the method comprising the steps of:

withdrawing two filaments from two fixedly located external spools to pass them into the strander flyer and then out around the flyer applying two turns to the two filaments, withdrawing a single filament from a fixedly located delivery spool internal to the flyer, bringing the first two filaments together with the second single filament by bringing the two filaments back into the flyer, and applying two turns to all three filaments in a direction opposite to that applied above to the first two filaments to remove the initial two turns from the first two filaments while applying two turns to the first filament to form a cord with the first two filaments parallel and the single filament helically formed therewith into a final cord structure.

* * * * *